United States Patent [19]

Sawby

[11] Patent Number: 4,604,803

[45] Date of Patent: Aug. 12, 1986

[54] FOLDING KNIFE

[76] Inventor: Scott Sawby, 500 W. Center Valley Rd., Sandpoint, Id. 83864

[21] Appl. No.: 763,666

[22] Filed: Aug. 8, 1985

[51] Int. Cl.[4] ..... B26B 1/04

[52] U.S. Cl. ..... 30/161; 30/155

[58] Field of Search ..... 30/155, 156, 160, 161; 7/118

[56] References Cited

U.S. PATENT DOCUMENTS

| | | | |
|---|---|---|---|
| 586,453 | 7/1897 | Normand | 7/118 X |
| 935,611 | 9/1909 | Perkins . | |
| 1,561,993 | 11/1925 | Nielsen | 7/118 |
| 1,810,031 | 6/1931 | Schrade | 7/118 X |
| 1,994,215 | 3/1935 | Gaunt | 30/155 |
| 2,461,941 | 2/1949 | Sutton | 30/161 X |
| 2,559,993 | 7/1951 | Parrigin et al. | 30/161 X |
| 3,263,329 | 8/1966 | Hennessy | 30/155 |
| 3,306,297 | 2/1967 | Voorhees | 30/156 X |
| 3,930,309 | 1/1976 | Collins | 30/161 |
| 3,942,249 | 3/1976 | Poehlmann | 30/160 |
| 4,133,106 | 1/1979 | Addis | 30/160 |
| 4,148,140 | 4/1979 | Lile | 30/161 |
| 4,170,061 | 10/1979 | Henry | 30/160 |
| 4,272,887 | 6/1981 | Poehlmann | 30/161 |
| 4,404,748 | 9/1983 | Wiethoff | 30/161 |
| 4,439,922 | 4/1984 | Sassano | 30/161 |
| 4,502,221 | 3/1985 | Pittman | 30/160 |

*Primary Examiner*—Jimmy C. Peters

*Attorney, Agent, or Firm*—Wells, St. John & Roberts

[57] ABSTRACT

A folding knife comprising a handle transversely flanking a knife blade movable within a slot formed through the handle. A complementary fixed bushing and pivot hole on the handle and knife blade provide a positive lock for the extended knife blade, in conjunction with a spring-biased ball that is located within the bushing and which bears radially outward against the surfaces of the pivot hole. The knife blade is manually releasable from its extended position by application of manual pressure to the blade in a direction perpendicular to bushing axis. The spring-biased ball also acts in cooperation with a notch in the pivot hole to serve as a releasable detent for maintaining the knife blade in its folded position.

14 Claims, 11 Drawing Figures

FIG 1
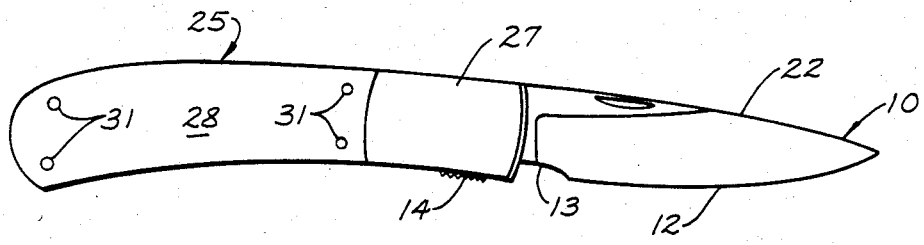
FIG 2
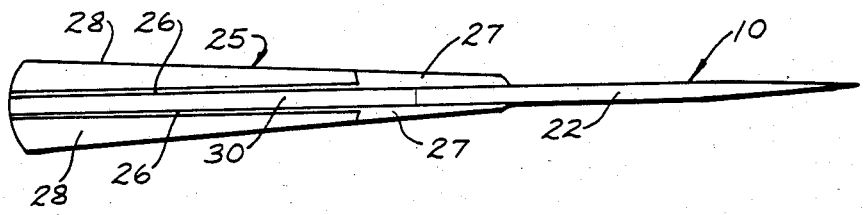
FIG 3
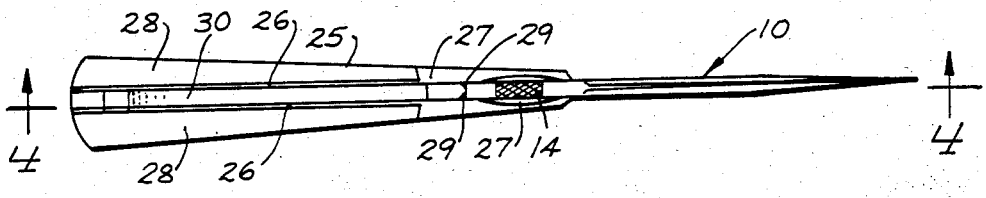
FIG 4
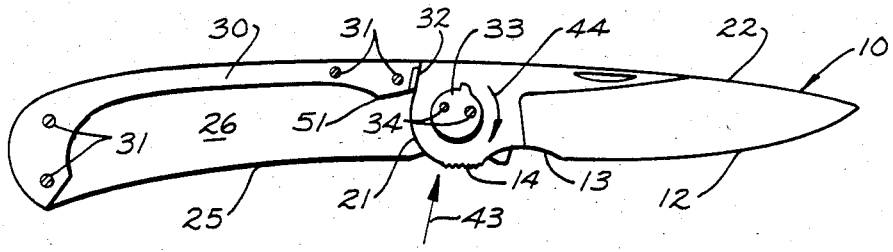
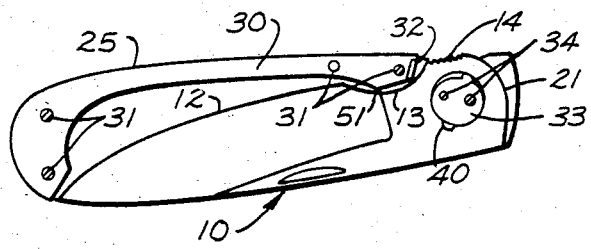
FIG 5

FOLDING KNIFE

FIELD OF THE INVENTION

This disclosure relates to a knife having a pivotable blade that can be locked in an extended or folded position relative to a slotted handle.

BACKGROUND OF THE INVENTION

Most folding knife structures utilize a partially movable spline along the center of the handle to bias the blade to an open or closed position by sliding contact against the tang of the blade. The required yieldable spring movement of the spine reduces the rigidity of the handle structure, since it limits the handle area across which rigid pins or other connectors can be located. This is a particular problem when handles are constructed of natural materials that expand, contract, or warp unevenly under different atmospheric conditions. Such handles require maximum support by an underlying rigid handle structure.

More refined versions of folding knives have been proposed, typically utilizing mechanically complicated latches to control blade position. Such latches can be manually operated from the exterior of the handle. They usually require manipulation of a protruding button or other mechanism. Such buttons or other mechanisms visually detract from the desired uniform outer appearance of the knife handle. It is also difficult to produce knives with sufficient precision to assure accurate and durable life to such mechanisms.

The present invention arose from an effort to produce a folding knife having a rigid, fixed backstrap along the center of the handle structure, and a releasable positive latch mechanism for the blade, requiring no button or other external mechanism for its operation. The latch mechanism is controlled solely by manual pressure applied to the tang of the knife blade. The latch maintains the blade in a rigid extended position relative to the handle insuring that the blade cannot be accidently folded without specific application of manual pressure at the tang itself.

The latch further maintains the knife blade in a folded position within the handle, acting as a yieldable detent to resist blade movement.

BRIEF DESCRIPTION OF THE DRAWINGS

The invention is illustrated in the accompanying drawings, in which:

FIG. 1 is a side elevation view of the open knife;

FIG. 2 is a top view;

FIG. 3 is a bottom view;

FIG. 4 is a sectional view taken along line 4—4 in FIG. 3;

FIG. 5 is a sectional view similar to FIG. 4, showing the knife blade in its folded position;

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 6:
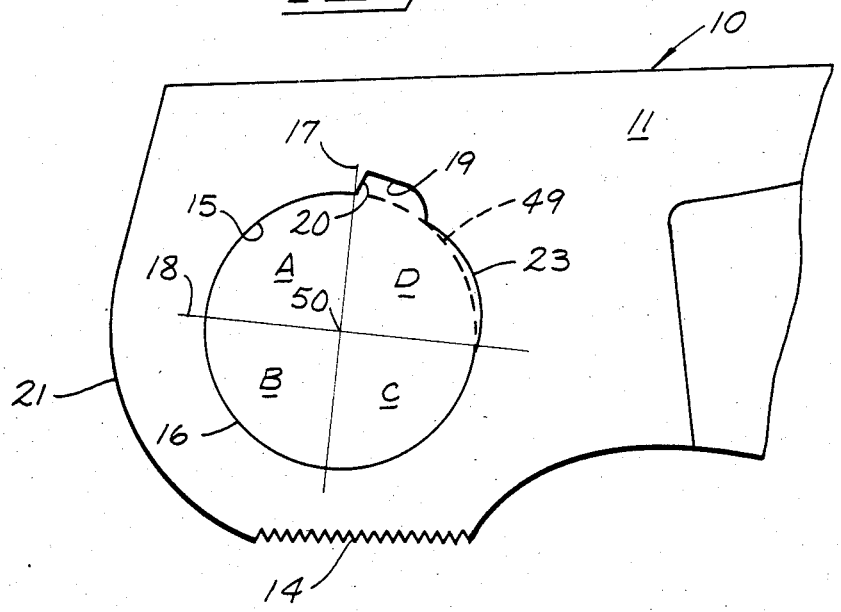
FIG. 6 is an enlarged fragmentary elevational view of the tang of a knife blade.
Figure 7:
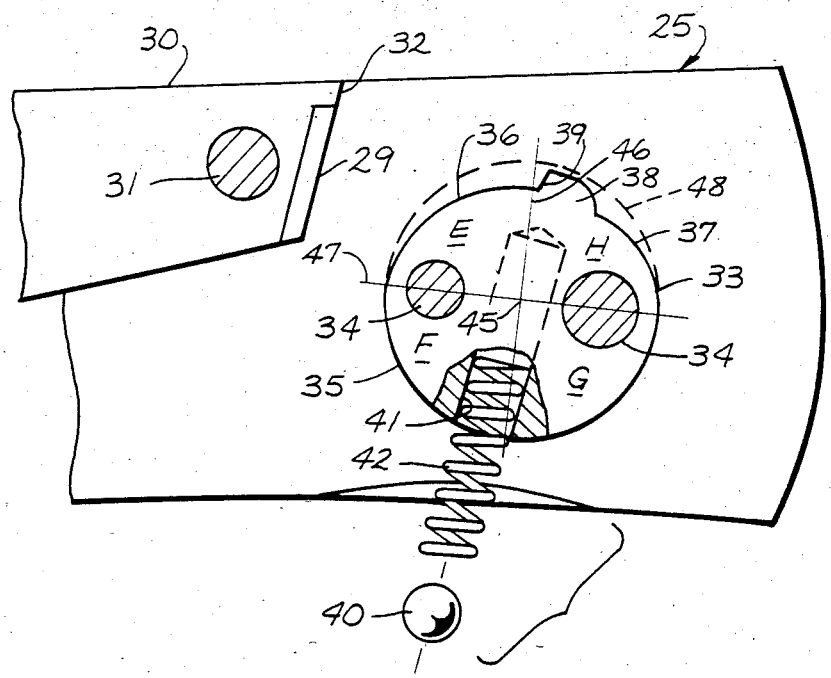
FIG. 7 is an enlarged fragmentary sectional view of a handle as seen along line 4—4 in FIG. 3, the detent mechanism being shown in exploded form.

FIGS. 1 through 5 show overall assembly views of the knife incorporating this novel folding assembly. FIGS. 6 and 7 show unassembled details of the blade and handle, respectively. FIGS. 8 through 11 illustrate various operational positions of the pivot assembly incorporated within the folding knife.

In general, the folding knife includes a knife blade 10 having a tang 11 formed at its inner end. A complementary handle 25 transversely flanks the tang 11 at the inner end of the handle. A pivot hole 15 is formed transversely through the tang 11. The details of its periphery are shown in detail in FIG. 6. A complementary bushing 33 is fixed to handle 25 and is shown in detail in FIG. 7. Pivot hole 15 extends transversely through tang 11 adjacent to the inner end of the blade 10, which terminates along a heel 21. The details of the pivot hole 15 will be described below.

Bushing 33 extends through the pivot hole 15 in the tang 11 for movably supporting the knife blade about a transverse axis across the handle. The combination of a lug 38 on bushing 33 and a complementary notch 19 formed in pivot hole 15, plus a spring-biased detent assembly within bushing 33, serves as latching means for selectively locking knife blade 10 at an extended position directed outward from the handle 25 as shown in FIGS. 1 through 4. This latching means is manually releasable in response to movement of the tang 11 relative to handle 25 in a preselected radial direction through the transverse axis about which the knife blade 10 is pivoted. Blade 10 can then be folded to the position shown in FIG. 5, where it is substantially sheathed within the confines of handle 25.

The knife blade 10 includes a conventional sharpened front edge 12 and a tapered blunt back edge 22 which extend outwardly to a pointed end. An arcuate choil 13 is formed between the edge 12 and tang 11 in the conventional manner. A knurled thumb pad 14 is located inwardly adjacent to choil 13, for purposes of described below.

Handle 25 includes a pair of transversely spaced lining plates 26 formed integrally with opposed bolsters 27 at one end of the handle. The lining plates 26 support handle panels 28, which can be made from bone, wood, or other natural or artificial materials for decorative purposes. The lining plates 26 and bolsters 27 are spaced transversely by a rigid backstrap 30 that extends almost the full length of handle 25. In contrast to the backstrap or spring in most folding knife assemblies, backstrap 30 is rigidly joined between the lining plates 26 and bolsters 27 by a series of transverse connecting pins 31. No part of the backstrap 30 is intended to be movable with respect to any other portion of the handle. Three of the pins 31 that hold the handle panels 28 at the sides of the knife also extend through the backstrap 30. The fourth pin holding each panel 28 across the open handle slot is discontinued at the inner surfaces of the respective lining plates 26 to leave the open blade slot unobstructed. Bushing 33 is fixed within handle 25 between bolsters 27 by a pair of transverse pins 34, as detailed in FIG. 7.

The inner end of backstrap 30 presents an open stop 32 adapted to be engaged by the heel 21 of blade 10 when blade 10 is fully extended (FIG. 4). Partial dirt grooves 29 are formed along the open stop 32 to minimize collection of dirt adjacent to the heel 21. Dirt grooves 29 are simply cut along the opposed side edges of open stop 32 to minimize the surface actually engaged along heel 21.

The inner position of backstrap 30 between the sides of handle 25 forms an open blade slot extending along the length of handle 25 and through the transversely spaced bolsters 27 at the end of handle 25 shown to the right in the drawings. The tang 11 of the knife blade 10 is mounted within this slot for movement relative to handle 25 between a folded position (FIG. 5) substantially sheathed within the blade slot and an extended position (FIGS. 1 through 4) protruding outward from the handle end.

Bushing 33 has a substantially cylindrical periphery generated about a transverse axis on the handle. The pivot hole 15, which is formed transversely through the tang 11, has a periphery that is substantially cylindrical and complementary to the periphery of bushing 33.

To lock the knife blade 10 in its extended position, the knife is provided with latching means formed at corresponding angular positions about the respective peripheries of bushing 33 and pivot hole 15. This latching means selectively locks blade 10 to handle 25 in a selected angular position relative to the bushing axis, which typically will be a fully extended position as shown in FIGS. 1 through 4. The latching means is releasable by manually shifting tang 11 relative to the bolsters 27 in a first direction. This direction is indicated by arrow 43 in FIGS. 4 and 9. It is perpendicular to the transverse bushing axis. The blade 10 is then free to be folded relative to handle 25 in a clockwise direction as shown by arrow 44 in FIGS. 4 and 9. The latching means also includes a spring-biased detent which serves as biasing means operably engaged between tang 11 and bushing 33 for yieldably urging tang 11 relative to the bolsters 27 in a direction diametrically opposite to the direction indicated by arrows 43. This function of the biasing means serves to maintain knife blade 10 in its extended position during knife usage.

The details of the manually releasable pivot between knife blade 10 and handle 25 are best understood by reference to FIGS. 6 through 11.

Bushing 33, which is fixed to handle 25 within the blade slot, has a substantially cylindrical periphery centered about a first axis identified in the drawings by the reference numeral 45. To better understand the geometry of bushing 33, it has been divided into four quadrants (E, F, G, and H) by two imaginary lines 46 and 47 that intersect at axis 45. The continuous outer peripheral wall about bushing 33 includes a semicylindrical peripheral surface 35 extending about quadrants F and G. The surface 35, which covers an arc of 180°, has opposite ends smoothly joining continuous curved surfaces 36 and 37 of slightly decreasing radius. A radially extended lug 38, having an inclined face 39, is formed on bushing 33 between the curved surfaces 36 and 37. Its outer radius, relative to axis 45, is equal to the radius of the semicylindrical peripheral surface 35. For comparison purposes, a continuation of the semicylindrical peripheral surface 35 is illustrated in broken lines in FIG. 7 at 48. The combination of semicylindrical surface 35 and the outermost surface along lug 38 serve as a pivotal bearing support for the periphery of the surrounding pivot hole 15 during folding movement of knife blade 10 relative to handle 25.

FIG. 6 similarly illustrates the corresponding geometry of pivot hole 15. It also is illustrated in four quadrants, labeled by the letters A, B, C and D, between two imaginary lines 17 and 18 which intersect at a second axis 50. The continuous inner peripheral wall about pivot hole 15 includes a partial cylindrical surface 16 that is extended from one side of a radially protruding notch 19 about an angle of approximately 270°. This spans the indicated quadrants A, B, and C. The partial cylindrical surface 16 smoothly joins a curved surface 23 of slightly increasing radius that leads to the remaining side of notch 19. The shape of notch 19 corresponds closely to the shape of lug 38 and includes a flat extended face 20 adapted to be engaged with the corresponding face 39 of lug 38 in surface-to-surface contact. Again, for comparison purposes, a continuation of the partial cylindrical surface 16 is shown in FIG. 6 by broken line 49.

Lug 38 and notch 19, together with a spring detent, provide latching means for selectively locking knife blade 10 in its extended position. The spring-biased detent comprises a spherical ball 40 seated against a compression spring 42 within a cylindrical recess 41 that extends inwardly through the semicylindrical peripheral surface 35 on bushing 33. The spring-biased ball 40 bears against the inner peripheral wall surfaces of pivot hole 15 in the assembled knife.

Figure 8:
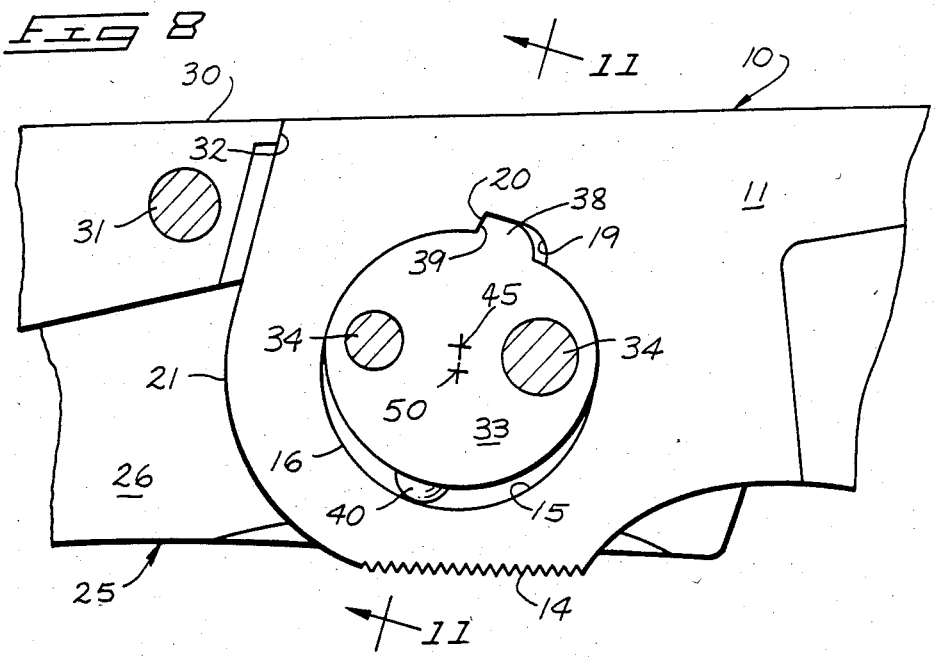
FIG. 8 is an enlarged fragmentary sectional view with the knife blade extended.
Figure 9:
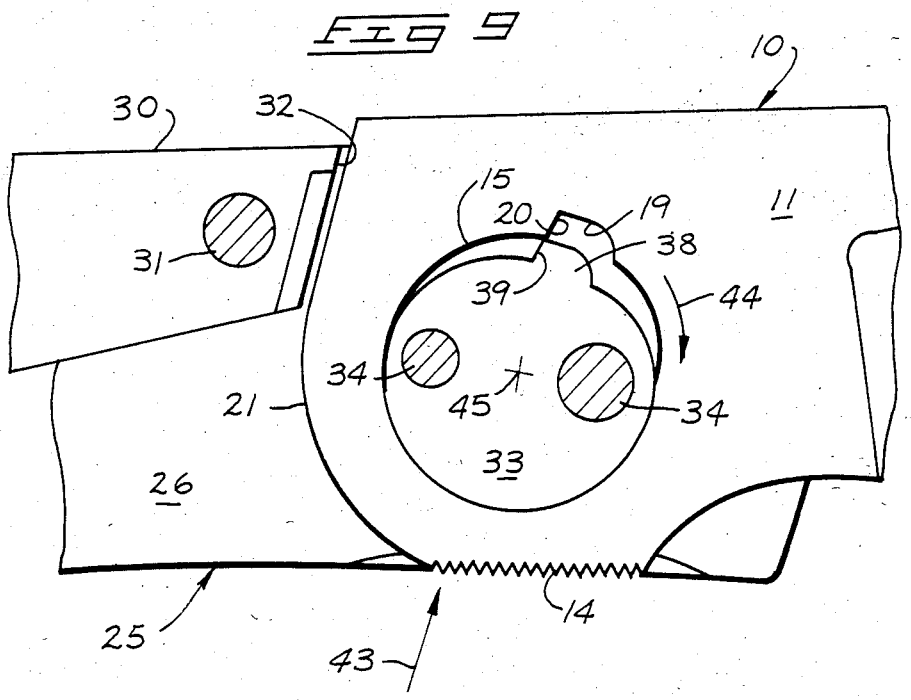
FIG. 9 is a view similar to FIG. 8, showing release of the latching mechanism.
Figure 10:
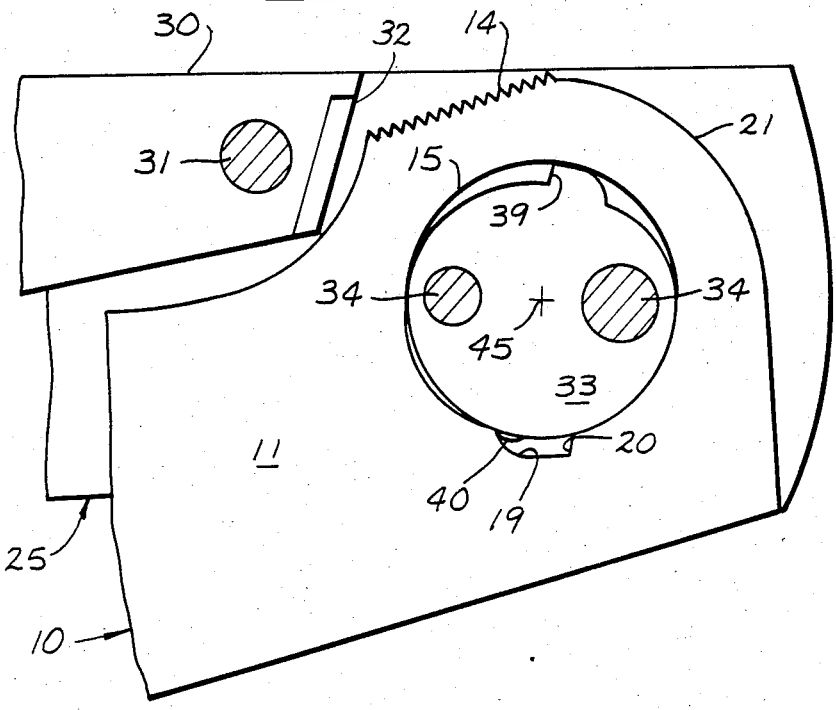
FIG. 10 is a view similar to FIG. 8, showing the knife blade in a folded position.
Figure 11:
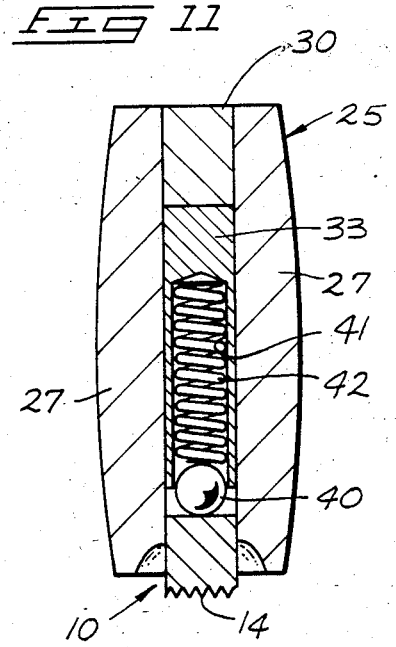
FIG. 11 is a fragmentary sectional view through the pivot assembly as seen along line 11—11 in FIG. 8.

The functional details of the latching means are best understood from a study of FIGS. 8, 9, and 10.

FIG. 8 shows the locked position of knife blade 10. The spring-biased ball 40 bears against a portion of the partial cylindrical surface 16 diametrically opposite to the interlocked lug 38 and notch 19. The respective axes 45 and 50 of bushing 33 and pivot hole 15 are offset from one another by a distance substantially corresponding to the protruding dimensions of lug 38 and notch 19. The faces 39 and 20 of lug 38 and notch 19 are in engagement. The heel 21 of knife blade 10 is in surface to surface engagement against the open stop 32 at the end of fixed backstrap 30. In this position, the knife blade 10 is securely fixed against movement relative to handle 25.

Blade 10 can be released for pivotal movement with respect to handle 25 by application of manual pressure at thumb pad 14 as indicated by arrow 43 in FIG. 9. This manual pressure shifts knife blade 10 in a direction substantially parallel to the engaged faces 39 and 20 of lug 38 and notch 19. This permits notch 19 to move outwardly beyond the outermost extention of lug 38. It also results in slight separation between the heel 21 of knife blade 10 and the open stop 32 of backstrap 30. The released position of the knife blade 10 is shown in FIG. 9. In this position, the axes 45 and 50 are coaxial, and knife blade 10 is now free to pivot in a clockwise direction as indicated by arrow 44.

The folded position of knife blade 10 is shown in FIG. 10. In this position, the tang 11 has been pivoted until choil 13 engages the closed stop 51 adjacent to the inner end of backstrap 30. The folded knife blade 10 is not otherwise contacted by the backstrap 30. The lack of physical engagment protects the sharpened front edge 12 from damage. The folded knife blade 10 is releasably held in the position shown in FIGS. 5 and 10 by the spring-biased ball 40, which projects partly into the notch 19. The ball 40 therefore serves as a spring-biased detent to maintain knife blade 10 in its folded position, in addition to its function as spring-biasing means to retain lug 38 within notch 19 when knife blade 10 is in its extended position.

Knife blade 10 can be returned to its extended position by simply grasping the blade and pivoting it outwardly from handle 25 after overcoming the resistance of ball 40.

The above mechanism provides a totally concealed latching system for locking a folding knife blade within a receiving handle. No external buttons or other mechanisms are required to operate the knife blade and permit it to fold in the manner described. The latching means provides a positive locking mechanism for the extended knife blade, as well as a frictionally releasable locking mechanism for the folded blade position. It also permits use of a rigid backstrap, which reinforces the handle structure and permits usage of materials in the handle panels 28 which are not of themselves dimensionally stable, such as natural bone and wood. Dimensional changes in these panels do not affect the overall strength and durability of the handle structure.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A folding knife, comprising:

a knife blade having a tang formed at its inner end;

a handle transversely flanking the tang;

a pivot hole formed through the tang of the knife blade;

bushing means fixed to the handle and extending through the pivot hole in the tang for movably supporting the knife blade about a transverse axis across the handle; and latching means on said bushing and pivot hole for selectively locking the knife blade at a preselected angular position relative to said transverse axis, said latching means being manually releasable in response to movement of the tang relative to the handle in a preselected direction perpendicular to said transverse axis.

2. The folding knife of claim 1 wherein said bushing means includes a semicylindrical peripheral surface centered about said transverse axis and having opposite ends smoothly joining continuous curved surfaces of decreasing radius.

3. The folding knife of claim 1 wherein said bushing means is defined by a continuous outer peripheral wall and includes a semicylindrical peripheral surface centered about said transverse axis and having opposite ends smoothly joining continuous curved surfaces of decreasing radius;

and a radially extended lug formed on said bushing means between said curved surfaces, said lug having an outer radius, relative to said transverse axis, equal to the radius of said semicylindrical peripheral surface.

4. The folding knife of claim 1 wherein said pivot hole is defined by a continuous inner wall formed across the tang of the knife blade and generated as a partial cylindrical surface.

5. The folding knife of claim 1 wherein said pivot hole is defined by a continuous inner wall formed across the tang of the knife blade and generated as a partial cylindrical surface having a radially extended notch at one end.

6. The folding knife of claim 1 wherein said pivot hole is defined by a continuous inner peripheral wall formed across the tang of the knife blade and generated as a partial cylindrical surface centered about a second transverse axis and having a radially extended notch at one end;

said partial cylindrical surface of the inner peripheral wall being extended about the pivot hole from one side of said notch about an angle of approximately 270° about said second transverse axis and smoothly joining a curved surface of increasing radius leading to the remaining side of said notch.

7. The folding knife of claim 1 wherein said bushing means is defined by a continuous outer peripheral wall and includes a semicylindrical peripheral surface centered about said transverse axis and having opposite ends smoothly joining continuous curved surfaces of decreasing radius:

and a radially extended lug formed on said bushing means between said curved surfaces, said lug having an outer radius, relative to said transverse axis, equal to the radius of said semicylindrical peripheral surface;

said pivot hole being defined by a continuous inner peripheral wall formed across the tang of the knife blade and generated as a partial cylindrical surface centered about a second transverse axis and having a radially extended notch at one end;

said partial cylindrical surface of the inner peripheral wall having a radius relative to the second transverse axis substantially equal to the radius of said semicylindrical peripheral surface, said partial cylindrical surface being extended about the pivot hole from one side of said notch about an angle of approximately 270° about said second transverse axis and smoothly joining a curved surface of increasing radius leading to the remaining side of said notch.

8. A folding knife, comprising:

a handle having a blade slot extending along its length and through transversely spaced bolsters at one handle end;

a knife blade having a tang movably mounted within the open blade slot at said one handle end, said knife blade being movable relative to the handle between a folded position substantially sheathed within the blade slot and an extended position protruding outward from said one handle end;

a bushing fixed to said handle blade at a location inwardly adjacent said one handle end, said bushing having a substantially cylindrical periphery generated about a transverse axis on said handle;

a pivot hole formed transversely through the tang of said knife blade, the periphery of said pivot hole having a substantially cylindrical periphery that complements the periphery of said bushing;

latching means formed at corresponding angular positions about the respective peripheries of said bushing and pivot hole for selectively locking said blade to said handle selected angular position relative to said transverse axis, said latching means being releasable by manually shifting the tang relative to the bolsters in a first direction perpendicular to said transverse axis;

said latching means further comprising biasing means operably engaged between the tang and bushing for yieldably urging the tang relative to the bolsters in a direction diametrically opposite to said direction along said selected radial line.

9. The folding knife of claim 8 wherein the dimension across the pivot hole along said selected radial line exceeds the dimension across the bushing along the same line by an amount equal to the corresponding depth of said latching means along parallel lines.

10. The folding knife of claim 8 wherein said latching means includes:

a radially protruding notch formed about the periphery of said pivot hole and a corresponding radially protruding lug formed about the periphery of said bushing.

11. The folding knife of claim 8 wherein said latching means includes:

a radially protruding notch formed about the periphery of said pivot hole and a corresponding radially protruding lug formed about the periphery of said bushing;

the dimensions across the pivot hole along the selected radial line exceeds the dimension across the bushing along the same line by an amount equal to the corresponding depths of the radially protruding notch and lug.

12. The folding knife of claim 8 wherein said latching means includes:

a radially protruding notch formed about the periphery of said pivot hole and a corresponding radially protruding lug formed about the periphery of said bushing;

the dimensions across the pivot hole along the selected radial line exceeds the dimension across the bushing along the same line by an amount equal to the corresponding depths of the radially protruding notch and lug;

said biasing means comprising a spherical ball that bears against a compression spring embedded within a recess formed in the bushing, along said ball being in yieldable rolling engagement with the periphery of said pivot hole.

13. The folding knife of claim 8 wherein the substantially cylindrical periphery of said bushing is interrupted by a radially protruding lug;

the substantially cylindrical periphery of said pivot hole being interrupted by a radially protruding notch.

14. The folding knife of claim 8 wherein the substantially cylindrical periphery of said bushing is interrupted by a radially protruding lug;

the substantially cylindrical periphery of said pivot hole being interrupted by a radially protruding notch;

the respective lug and notch being complementary to one another in size and shape.

* * * * *